US010444692B2

(12) United States Patent
Wang et al.

(10) Patent No.: US 10,444,692 B2
(45) Date of Patent: Oct. 15, 2019

(54) ASSEMBLING APPARATUS AND MULTICOMPONENT STRUCTURE USING THE SAME

(71) Applicant: CLOUD NETWORK TECHNOLOGY SINGAPORE PTE., LTD., Singapore (SG)

(72) Inventors: Wen-Chen Wang, New Taipei (TW); Huang-Jyun Lu, New Taipei (TW)

(73) Assignee: Cloud Network Technology Singapore Pte. Ltd., Singapore (SG)

( * ) Notice: Subject to any disclaimer, the term of this patent is extended or adjusted under 35 U.S.C. 154(b) by 571 days.

(21) Appl. No.: 15/260,268

(22) Filed: Sep. 8, 2016

(65) Prior Publication Data

US 2018/0023603 A1 Jan. 25, 2018

(30) Foreign Application Priority Data

Jul. 20, 2016 (CN) ..... 2016 1 0581222

(51) Int. Cl.
*G03G 15/00* (2006.01)

(52) U.S. Cl.
CPC ..... *G03G 15/6502* (2013.01)

(58) Field of Classification Search
CPC ..... G03G 15/6502; G03G 15/6508; G03G 15/6511; G03G 15/6514; F16B 7/042; F16B 21/12; F16B 21/125; Y10T 403/587; Y10T 403/59; Y10T 403/598; Y10T 403/60; Y10T 403/602; Y10T 403/604; B23P 19/04
See application file for complete search history.

(56) References Cited

U.S. PATENT DOCUMENTS 1,533,619 A * 4/1925 Thompson ..... B25B 23/0035 29/437
3,627,312 A * 12/1971 Fackler ..... G03G 15/6502 271/221
4,243,342 A * 1/1981 Marto ..... F16B 21/12 280/515
4,280,692 A * 7/1981 Hutchinson ..... B65H 1/04 271/127
4,602,890 A * 7/1986 Duda ..... F16B 7/105 403/105

(Continued)

FOREIGN PATENT DOCUMENTS

JP 06247569 A * 9/1994
TW 201434374 A 9/2014

*Primary Examiner* — Jonathan P Masinick
(74) *Attorney, Agent, or Firm* — ScienBiziP, P.C.

(57) ABSTRACT

The disclosure discloses an apparatus for assembling a multi-component structure. The apparatus for assembling includes a pushing member fixed to a first component, a latch unit corresponding to the pushing member, the latch unit fixed to a second component. when the first component is not installed to a predetermined position of the second component, the latch unit stays in a locking position to prevent the second component from being installed to a third component; when the first component is installed to the predetermined position of the second component, the latch unit stays in an unlocking position and the second component is released to be installed to the third component. A multi-component structure is further disclosed.

20 Claims, 4 Drawing Sheets

(56) References Cited

U.S. PATENT DOCUMENTS

| | | | | |
|---|---|---|---|---|
| 6,674,983 | B2 * | 1/2004 | Enomoto | G03G 15/6502 271/117 |
| 7,448,613 | B2 * | 11/2008 | Takahashi | B65H 1/12 271/157 |
| 7,708,265 | B2 * | 5/2010 | Kusama | B65H 1/266 271/117 |
| 8,752,810 | B2 * | 6/2014 | Anderson | F16F 9/56 188/300 |

* cited by examiner

ASSEMBLING APPARATUS AND MULTICOMPONENT STRUCTURE USING THE SAME

FIELD

The subject matter herein generally relates to a paper cassette and a printing device using the paper cassette.

BACKGROUND

In assembly of some structures or units, multiple installation steps could be involved. During the assembly process, unpredictable damage would be caused if the previous step was not accomplished or the component in the previous step was not installed to a predetermined position. Therefore, occurrence of an error in the installation order should be prevented.

BRIEF DESCRIPTION OF THE DRAWINGS

Implementations of the present technology will now be described, by way of example only, with reference to the attached figures.

DETAILED DESCRIPTION

Figure 1:
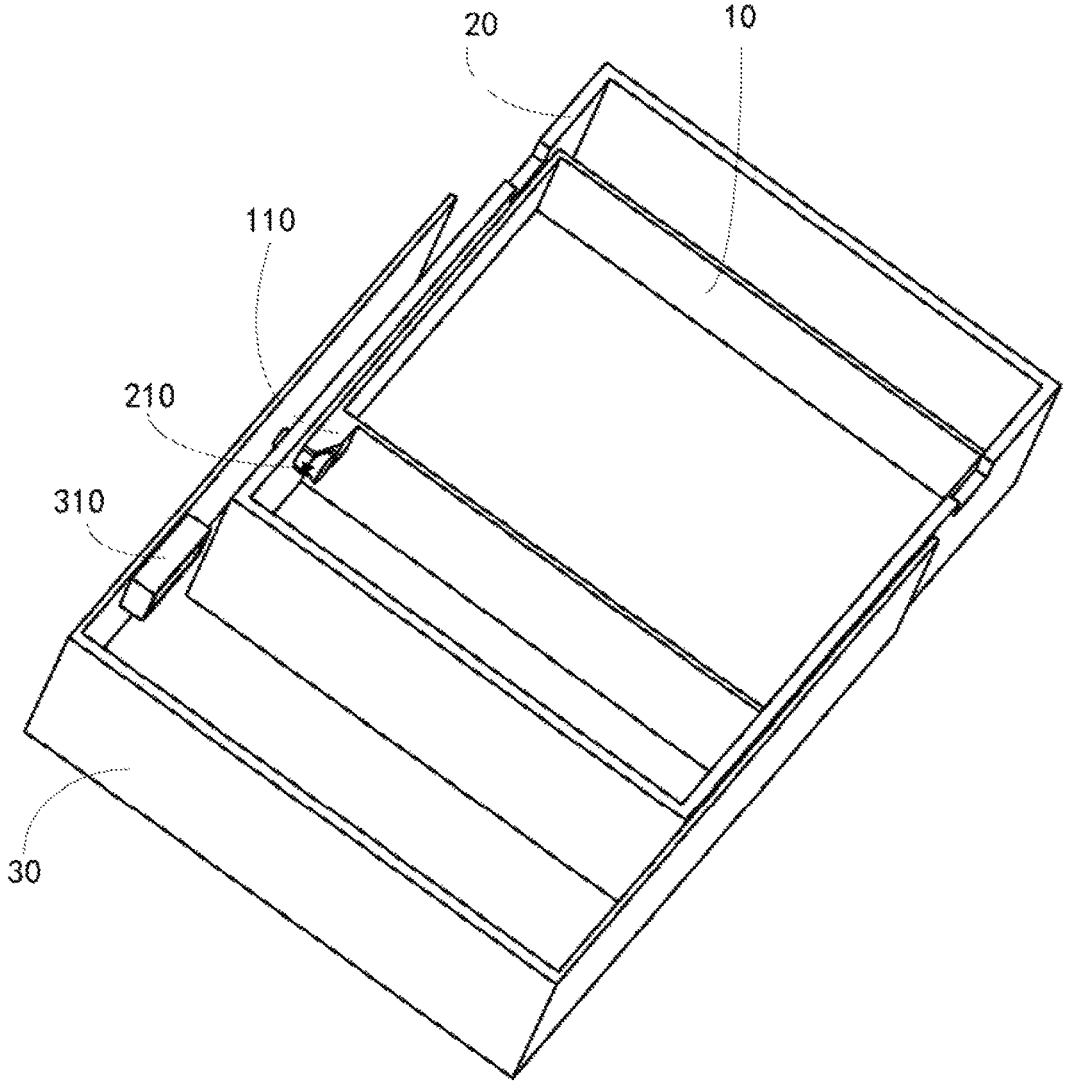
FIG. 1 is an isometric view of one embodiment of an assembling apparatus and a multi-component structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an apparatus for assembling a multi-component structure.

Figure 2:
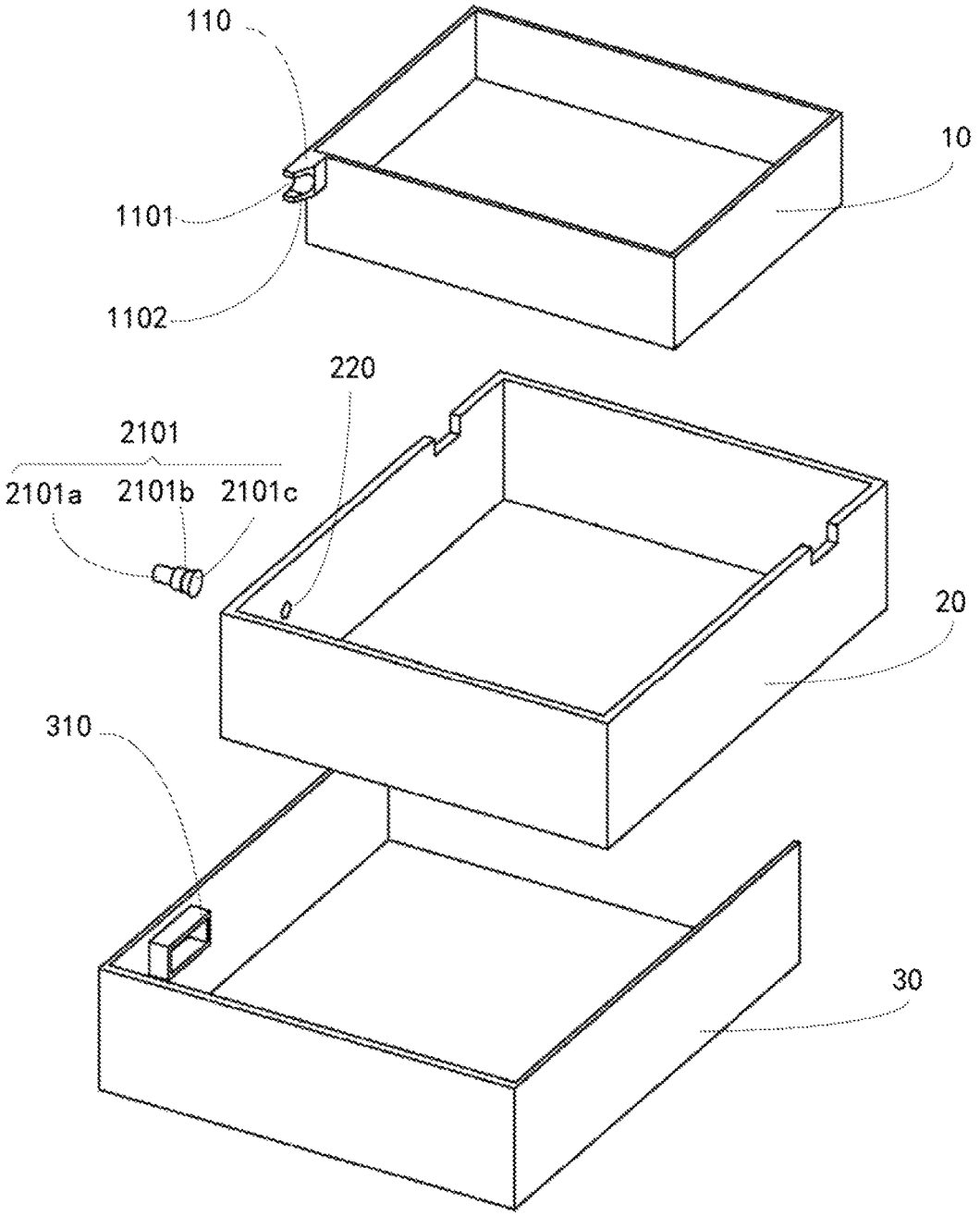
FIG. 2 is an exploded view of the apparatus for assembling and the multi-component structure of FIG. 1.

FIGS. 1 and 2 illustrates one embodiment of an apparatus for assembling and a multi-component structure.

The assembling apparatus includes a pushing member 110 and a latch unit 210. The pushing member 110 is fixed to a first component 10, and the pushing member 110 moves together with the first component 10 along a predetermined installation direction of the first component 10. The latch unit 210 is correspond to the pushing member 110, and the latch unit 210 is fixed to a second component 20.

Figure 3:
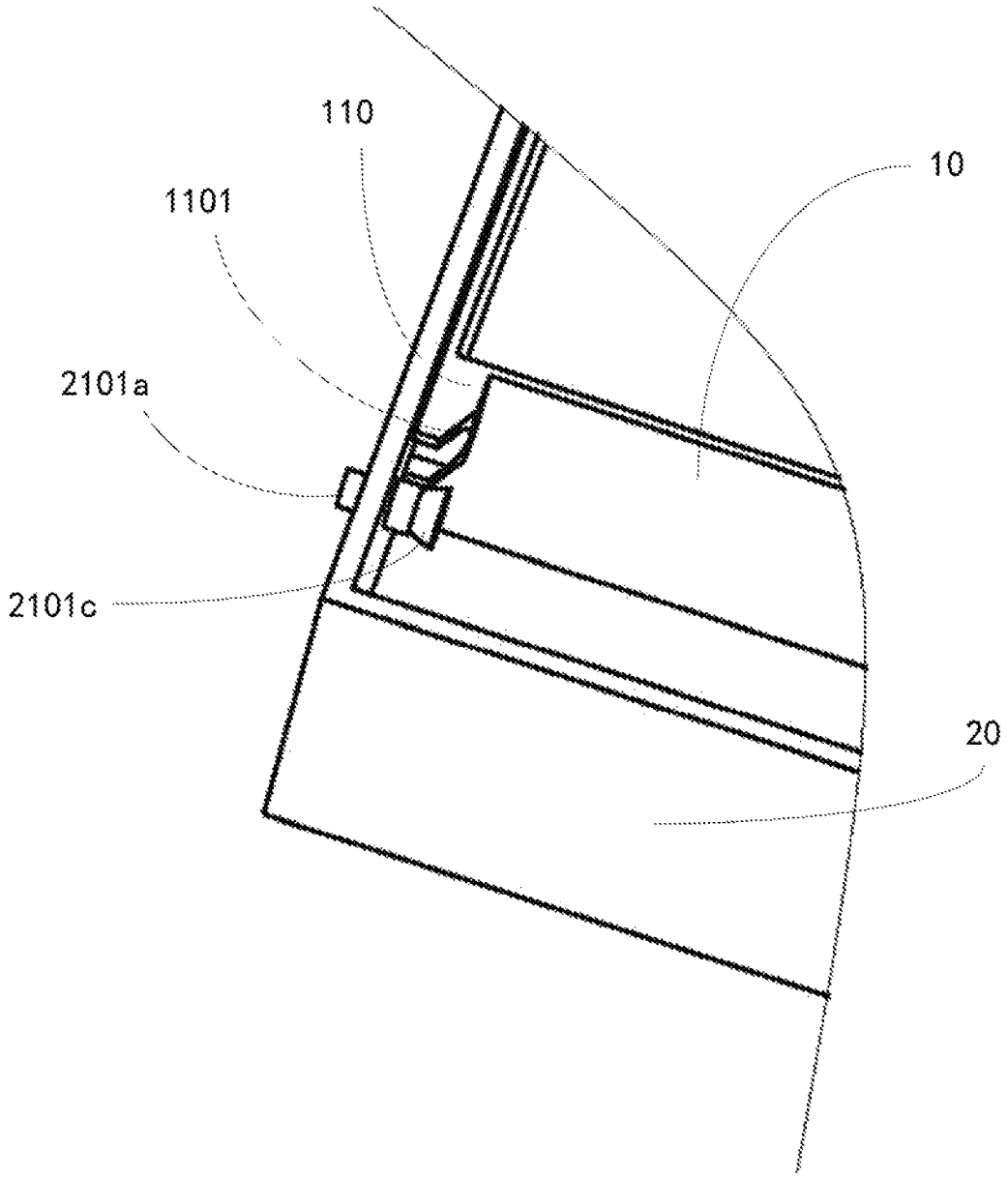
FIG. 3 is a partial view of a latch unit of the assembling apparatus in a locking position.
Figure 4:
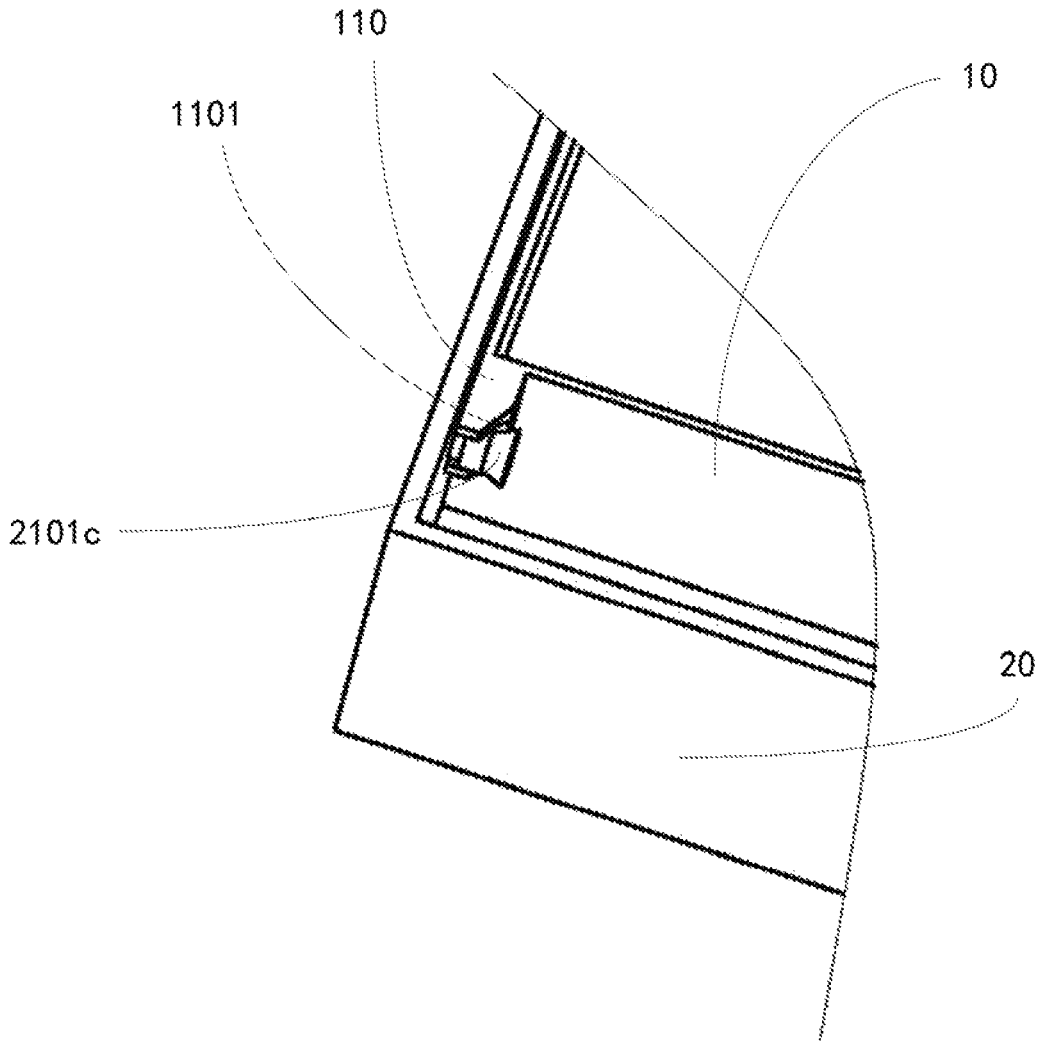
FIG. 4 is a partial view of the latch unit of FIG. 3 in an unlocking position.

Please refer to FIG. 3 and FIG. 4 at the same time. The latch unit 210 can be switched between two working positions. When the first component 10 is not installed to a predetermined position of the second component 20, the latch unit 210 stays in a locking position, so as to prevent the second component 20 from being installed to a third component 30. When the first component 10 is installed to the predetermined position of the second component 20, the latch unit 210 can be switched to an unlocking position, and the second component 20 is released to be installed to the third component 30.

A mounting surface of the second component 20 can include an opening 220. One end of the latch unit 210 includes a protrusion, the other end of the latch unit 20 includes a linkage corresponding to the pushing member 110. When the protrusion protrudes out of the mounting surface of the second component 20 via the opening 220, the latch unit 210 stays in the locking position, the protrusion interferes with the third component 30, so as to prevent the second component 20 from being installed to the third component 30. When the linkage is driven by the pushing member 110, the protrusion retreats into the inner side of the mounting surface of the second component 20, the latch unit 210 reaches an unlocking position.

In corresponding with the latch unit 210, a block member 310, such as a baffle, can be located on the third component 30, when the first component 10 is not installed to the predetermined position of the second component 20, the block member 310 interferes with the protrusion of the latch member 210, so as to prevent the second component 20 from being installed to the third component 30.

In at least one embodiment, the latch unit 210 can include a pin 2101. The pin 2101 can include a pin head 2101*b* and a pin rod 2101*a*. The pin head 2101*b* is located in the inner side of the mounting surface of the second component 20, the pin rod 2101*a* is connected to the pin head 2101*b* and used as the protrusion. The pin rod 2101*a* can slide in the opening with the leading of the pin head 2101*b*. When the pin rod 2101*a* protrudes out of the mounting surface via the opening 220, the latch unit 210 stays in the locking position, when the pin head 2101*b* is driven by the pushing member 110, the pin rod 2101*a* retreats into the inner side of the mounting surface of the second component 20, the latch unit 210 reaches an unlocking position. In this case, the pushing member 110 can contact with the pin head 2101*b* to drive the pin head 2101*b*.

In order to form a linkage between the pushing member 110 and the pin 2101, the pushing member 110 can be a wedge block. When the first component 10 is installed to the predetermined position of the second component 20, the front end of the wedge block is inserted between the pin head 2101*b* and the mounting surface of the second component 20, the pin head 2101*b* can be driven by the bevel 1101 of the wedge block to pull the pin rod 2101*a* back inside the mounting surface of the second component 20. When the first component 10 is not installed to the predetermined position of the second component 20, the front end of the wedge block is separated from the pin head 2101*b* and the mounting surface of the second component 20, the pin head 2101*b* is close to the mounting surface of the second component 20, and the pin rod 2101*a* protrudes out of the mounting surface of the second component 20, the pin rod 2101*a* interferes with the third component 30, so as to prevent the second component 20 from being installed to the third component 30.

A slot 1102 can be formed in the front end of the wedge block. The slot 1102 extends along the moving direction of the wedge block, the pin rod 2101*a* can be received in the slot 1102, when the wedge block moves, the pin rod 2101*a* slides in the slot 1102, so as to provide enough moving distance for the wedge block.

Similarly, the diameter of the pin head 2101*b* can contract towards the pin rod 2101*a* to form a frustum of a cone 2101*c*, the pushing member 110 can be formed as a cuboid, when the first component 10 is installed to the predetermined position of the second component, the front end of the pushing member 110 abuts on the frustum of a cone 2101*c* to drive the pin head 2101*b* to slide in the opening 220, so as to pull the pin rod 2101*a* back inside the mounting surface of the second component 20.

In order to keep the latch unit 210 in locking position when the first component 10 is not installed to the predetermined position of the second component 20, an elastic member (not shown) can be connected between the pin head 2101*b* and the mounting surface of the second component 20. When the first component 10 is installed to the predetermined position of the second component 20, the elastic member is elastically deformed, When the first component 10 is not installed to the predetermined position of the second component, the elastic member recovers under recovery stress to keep the pin rod 2101*a* stays out of the mounting surface of the second component 20 to keep the latch unit 210 in locking position, so as to avoid the invalidation caused by the free movement of the pin rod 2101*a*.

The elastic member can be chosen as a spring or a clip.

The embodiments shown and described above are only examples. Even though numerous characteristics and advantages of the present technology have been set forth in the foregoing description, together with details of the structure and function of the present disclosure, the disclosure is illustrative only, and changes may be made in the details, including matters of shape, size, and arrangement of the parts within the principles of the present disclosure, up to and including the full extent established by the broad general meaning of the terms used in the claims.

What is claimed is:

1. An assembling apparatus for a multi-component structure, the assembling apparatus comprising:

a pushing member fixed to a first component, the pushing member is moveable with the first component along an installation direction of the first component; and a latch unit corresponding to the pushing member, the latch unit mounted to a second component;

when the first component is not installed to a predetermined position of the second component, the latch unit is located in a locking position to prevent the second component from being installed to a third component; when the first component is installed to the predetermined position of the second component, the latch unit is located in an unlocking position, and the second component is released to be installed to the third component.

2. The apparatus for assembling of claim 1, wherein the second component comprises a mounting surface, which defines an opening, one end of the latch unit comprises a protrusion, the other end of the latch unit comprises a linkage corresponding to the pushing member, when the protrusion protrudes out of the mounting surface via the opening, the latch unit stays in the locking position; when the linkage is driven by the pushing member, the protrusion retreats into the inner side of the mounting surface, the latch unit reaches the unlocking position.

3. The apparatus for assembling of claim 2, wherein the latch unit comprises a pin, the pin comprises a pin head located in the inner side of the mounting surface and a pin rod connected to the pin head; when the pin rod protrudes out of the mounting surface via the opening, the latch unit stays in the locking position, when the pin head is driven by the pushing member, the pin rod retreats into the inner side of the mounting surface, the latch unit reaches an unlocking position.

4. The apparatus for assembling of claim 3, wherein the latch unit further comprises an elastic member connected between the pin head and the mounting surface, when the first component is not installed to the predetermined position of the second component, the pin rod stays out of the mounting surface to keep the latch unit in the locking position.

5. The apparatus for assembling of claim 4, wherein the elastic member is a spring or a clip.

6. The apparatus for assembling of claim 3, wherein the pushing member is a wedge block, when the first component is installed to the predetermined position of the second component, a front end of the wedge block is inserted between the pin head and the mounting surface, the pin head is driven by the bevel of the wedge block to pull the pin rod back inside the mounting surface.

7. The apparatus for assembling of claim 6, wherein the front end of the wedge block defines a slot extending along the moving direction of the wedge block, when the wedge block moves, the pin rod slides in the slot.

8. The apparatus for assembling of claim 3, wherein the diameter of the pin head contracts towards the pin rod to form a frustum of a cone, when the first component is installed to the predetermined position of the second component, the front end of the pushing member abuts on the frustum of a cone to drive the pin head, so as to pull the pin rod back inside the mounting surface.

9. The apparatus for assembling of claim 2, wherein the apparatus for assembling further comprises a block member located on the third component, when the first component is not installed to the predetermined position of the second component, the block member interferes with the protrusion of the latch member to prevent the second component from being installed to the third component.

10. The apparatus for assembling of claim 9, wherein the block member is a baffle protruding out of the mounting surface of the third component.

11. A multi-component structure comprising:

a first component;

a second component to which the first component is installed;

a third component to which the second component is installed; and an apparatus for assembling comprising:

a pushing member fixed to the first component, the pushing member moves with the first component along the installation direction of the first component; and a latch unit corresponding to the pushing member, the latch unit fixed to the second component;

when the first component is not installed to a predetermined position of the second component, the latch unit stays in a locking position to prevent the second component from being installed to the third component; when the first component is installed to the predetermined position of the second component, the latch unit stays in an unlocking position and the second component is released to be installed to the third component.

12. The multi-component structure of claim 11, wherein a mounting surface of the second component comprises an opening, one end of the latch unit comprises a protrusion, the other end of the latch unit comprises a linkage corresponding to the pushing member, when the protrusion protrudes out of the mounting surface via the opening, the latch unit stays in the locking position; when the linkage is driven by the pushing member, the protrusion retreats into the inner side of the mounting surface, the latch unit reaches an unlocking position.

13. The multi-component structure of claim 12, wherein the latch unit comprises a pin, the pin comprises a pin head located in the inner side of the mounting surface and a pin rod connected to the pin head; when the pin rod protrudes out of the mounting surface via the opening, the latch unit stays in the locking position, when the pin head is driven by the pushing member, the pin rod retreats into the inner side of the mounting surface, the latch unit reaches an unlocking position.

14. The multi-component structure of claim 13, wherein the latch unit further comprises an elastic member connected between the pin head and the mounting surface, when the first component is not installed to the predetermined position of the second component, the pin rod stays out of the mounting surface to keep the latch unit in locking position.

15. The multi-component structure of claim 14, wherein the elastic member is a spring or a clip.

16. The multi-component structure of claim 13, wherein the pushing member is a wedge block, when the first component is installed to the predetermined position of the second component, the front end of the wedge block insert between the pin head and the mounting surface, the pin head is driven by the bevel of the wedge block to pull the pin rod back inside the mounting surface.

17. The multi-component structure of claim 16, wherein the front end of the wedge block comprises a slot extending along the moving direction of the wedge block, when the wedge block moves, the pin rod slides in the slot.

18. The multi-component structure of claim 13, wherein the diameter of the pin head contracts towards the pin rod to form a frustum of a cone, when the first component is installed to the predetermined position of the second component, the front end of the pushing member abuts on the frustum of a cone to drive the pin head, so as to pull the pin rod back inside the mounting surface.

19. The multi-component structure of claim 12, wherein the apparatus for assembling further comprises a block member located on the third component, when the first component is not installed to the predetermined position of the second component, the block member interferes with the protrusion of the latch member to prevent the second component from being installed to the third component.

20. The multi-component structure of claim 19, wherein the block member is a baffle protrudes out of the mounting surface of the third component.

* * * * *